United States Patent [19]

Hobbs

[11] Patent Number: 4,468,825

[45] Date of Patent: Sep. 4, 1984

[54] OXYGEN REMOVAL SYSTEM FOR A BED

[76] Inventor: James R. Hobbs, 5012 Kinglet, Houston, Tex. 77035

[21] Appl. No.: 461,846

[22] Filed: Jan. 28, 1983

[51] Int. Cl.[3] ..... A47C 21/04; A47C 21/00; F24F 9/00

[52] U.S. Cl. ..... 5/508; 5/284; 5/469; 98/36; 128/910

[58] Field of Search ..... 5/508, 468, 469, 423, 5/284, 159 V; 128/910, 139; 98/36

[56] References Cited

U.S. PATENT DOCUMENTS

| | | | |
|---|---|---|---|
| 630,565 | 8/1899 | Safran | 5/469 |
| 773,138 | 10/1904 | Finchum | 5/469 |
| 1,475,912 | 11/1923 | Williams | 5/469 |
| 2,695,413 | 11/1954 | Ter Maat | 5/469 |
| 3,505,989 | 4/1970 | Truhan | 98/36 |
| 3,537,447 | 11/1970 | Gauthier | 128/139 |
| 3,928,876 | 12/1975 | Starr | 5/469 |
| 4,305,168 | 12/1981 | Holter et al. | 5/512 |

FOREIGN PATENT DOCUMENTS

| | | | |
|---|---|---|---|
| 2020384 | 11/1979 | United Kingdom | 128/910 |

*Primary Examiner*—Alexander Grosz
*Assistant Examiner*—Vinh Luong
*Attorney, Agent, or Firm*—Fulbright & Jaworski

[57] ABSTRACT

A system for removing oxygen from and around hospital beds for reducing the fire danger. A manifold having a plurality of sections is connected to and is supported from the frame. The sections are connected together by flexible joints and include a connection for attachment to an exhaust. A first plurality of suction tubes is connected to the manifold with their ends positioned adjacent the mattress for removing oxygen from and around the mattress. A second plurality of suction tubes is connected to the manifold and extend downwardly for removing oxygen from beneath the bed. Suction cups may be connected to the ends of the first suction tubes positioned adjacent the mattress. The suction cups are positioned adjacent the sides and the bottom of the mattress and are supported from the frame and springs.

6 Claims, 3 Drawing Figures

16
10
34
22
14
42
24
20
12
32
44
36
30
36
42
44

40
42
12
40
42
40
14
42
40
40
12
22
24
44
20
46
44
46

30
37
36
37
32
38

OXYGEN REMOVAL SYSTEM FOR A BED

BACKGROUND OF THE INVENTION

Oxygen is commonly used to aid patients having various respiratory difficulties. The explosive or fire supporting properties of oxygen are well known. Therefore, proper precautions should be taken (but often are not) while the patient is using oxygen to prevent people from smoking or making sparks in the vicinity of the oxygen.

However, even after the oxygen usage has been removed, the patient's hospital bed and surrounding area is permeated with oxygen. And in fact great quantities of oxygen are absorbed into the mattress and bed covers. This absorbed oxygen takes an extended period of time to dissipate. And with the removal of the oxygen equipment, people are not aware of the dangers of the remaining oxygen and tend to become careless.

The present invention provides an oxygen removal system for removing oxygen from and around hospital beds thereby reducing the danger of fire.

SUMMARY

The present invention is directed to the provision of an oxygen removal system for a bed having a frame, springs and mattress and includes a manifold adapted to be connected to and supported from the bed frame which includes an exhaust connection adapted to be connected to suitable exhaust means. A plurality of first suction tubes are connected to the manifold with their ends positioned adjacent the mattress for removing oxygen from the mattress. In addition, a second plurality of suction tubes is connected to the manifold and extend downwardly for removing oxygen which may have accumulated beneath the bed.

Still a further object is the provision of a plurality of suction cups connected to the ends of the first suction tubes which are positioned adjacent the mattress on the sides and the bottom. The suction tubes may be supported from the springs or the frame.

Still a further object of the present invention is wherein the manifold forms part of the bed frame and includes a plurality of rigid sections connected together by a flexible joint.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
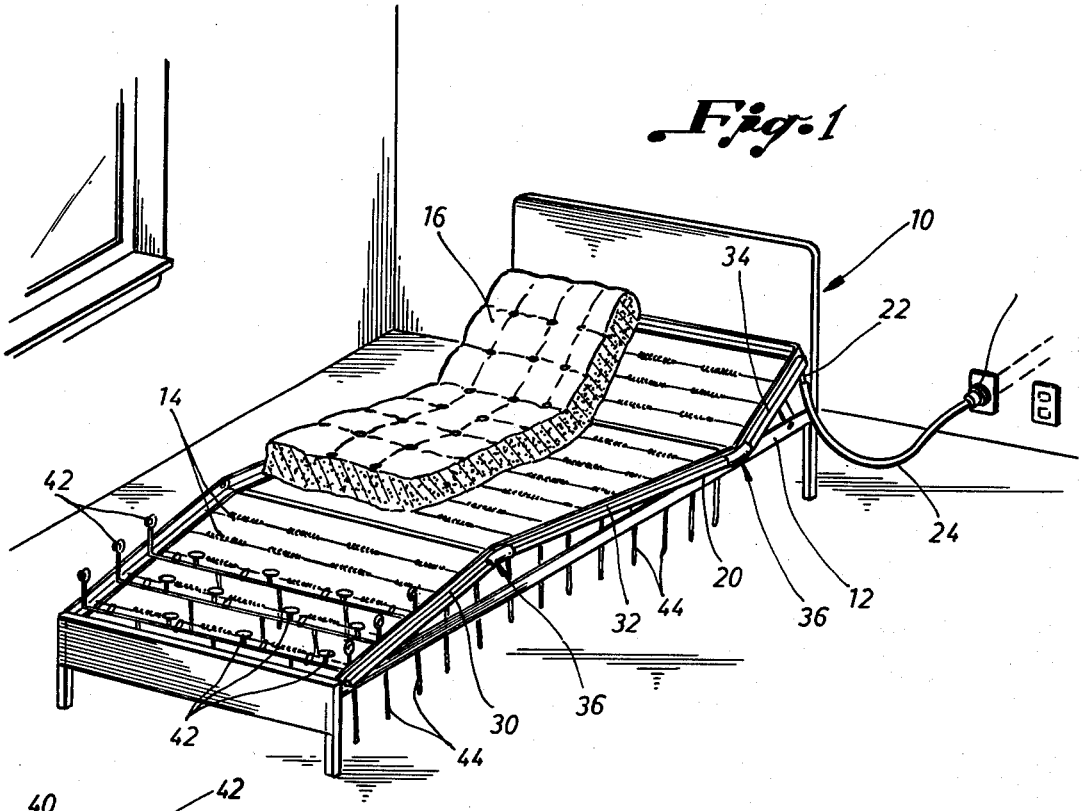
FIG. 1 is a perspective view of a hospital bed incorporating the oxygen removal system of the present invention.
Figure 2:
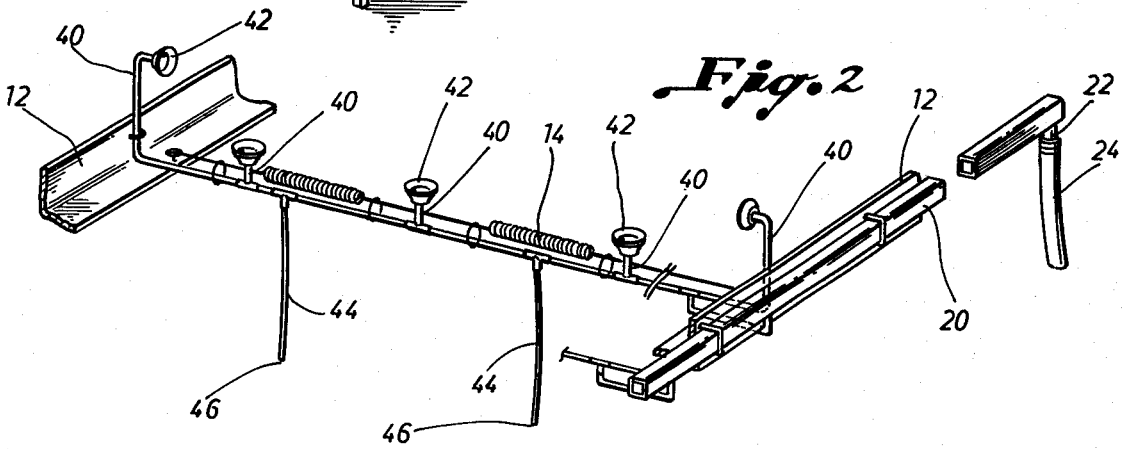
FIG. 2 is an enlarged fragmentary perspective view of the oxygen removal system of the present invention.

Referring now to the drawing, and particularly to FIG. 1, the reference numeral 10 indicates a hospital bed having a suitable frame 12, springs 14, and mattress 16. Even after oxygen use has ceased, a substantial amount of oxygen remains which permeates the mattress 16 and covers for a prolonged period of time and extends around the area of the bed 10, particulary under the bed 10.

The present invention is directed to an oxygen removal system which generally includes a manifold 20 which is adapted to be connected to and supported from the frame 12 for collecting oxygen therein from and around the bed 10 and exhausting that oxygen to an area remote from the bed 10. Thus the manifold includes a connection 22 adapted to be connected to any suitable exhaust means such as a hose 24 which is connected to a conventional hospital exhaust means 26 having a pump (not shown) for disposing of the oxygen to a safe location.

Figure 3:
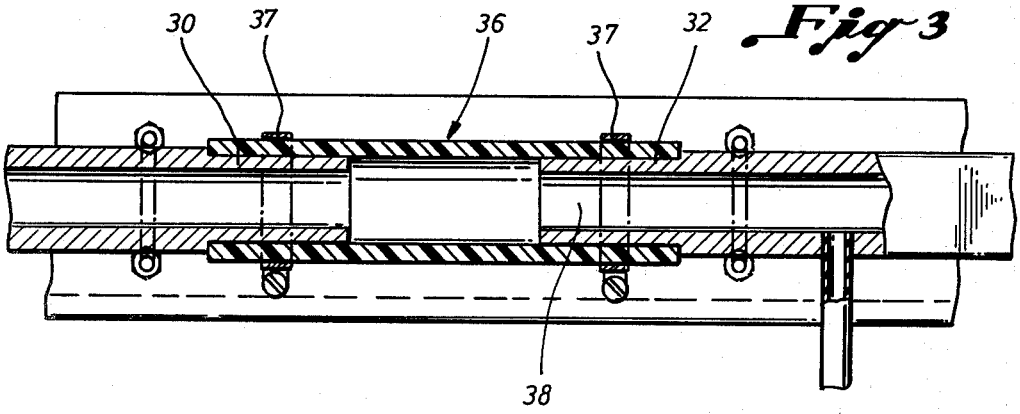
FIG. 3 is an enlarged fragmentary cross-sectional view illustrating a flexible connection between two sections of the manifold of the present system.

The manifold 20 may include a plurality of sections such as 30, 32 and 34 which are connected together by a flexible joint. Thus sections 30 and 32 are connected together by a flexible joint 36 and sections 32 and 34 are similarly joined together by a similar joint 36. Referring now to FIG. 3, while any suitable type of flexible joint may be utilized, the flexible joint 36 may conveniently be a flexible hose having a passageway 38 therethrough leading to the interior of the manifold sections such as 30 and 32. The hose 36 may be conveniently connected to the manifold sections 30 and 32 such as by clamps 37. The flexible joint 36 allows the individual manifold sections 30, 32 and 34 to be raised and lowered in a conventional hospital bed frame 12. The manifold 20 may be constructed of square metal conduits and therefore form a part of the frame 12 to add rigidity and support to the frame 12 itself.

In order to pull by suction as much of the oxygen as feasible from the mattress 16, a first plurality of suction tubes 40 is provided which are connected to the manifold 20. The free ends of the suction tubes 40 are positioned adjacent to the mattress 16 at a plurality of locations for removing oxygen from the mattress. Preferably, suction cups 42 are connected to the free ends and the suction tubes are supported against both the sides and the bottom of the mattress 16. The suction tubes 40 and the suction cups 42 may be physically supported from the bed springs 14 and/or the frame 12. The cups 42 are used instead of merely the ends of the tubes 40 as they can engage a greater area along the exterior surface of the mattress 16 and withdraw a greater volume of oxygen.

A second plurality of suction tubes 44 are connected to the manifold 20 and extend downwardly for removing oxygen from beneath the bed where it accumulates. The ends 46 of the tubes 44 may extend any suitable distance from the bottom of the bed 10 to slightly above the floor on which the bed can rest. Preferably the ends 46 extend to a few inches off of the floor.

In operation, the conduit 20 is plugged into the exhaust system 26 thereby drawing air and oxygen through the suction cups 42 and the ends 46 of the first and second suction tubes 40 and 44, respectively. The air and oxygen is drawn through the manifold 20 and is disposed in a safe area. The present system of oxygen removal will quickly and safely remove the dangerous accumulation of oxygen away from the bed 10.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. An oxygen removal system for a bed having a frame and mattress comprising, a manifold adapted to be connected to and supported from the frame and including an exhaust connection adapted to be connected to exhaust means, a first plurality of suction tubes connected to the manifold with the ends positioned adjacent the mattress for removing oxygen from the mattress, and a second plurality of suction tubes connected to the manifold and extending downwardly for removing oxygen from beneath the bed.

2. The apparatus of claim 1 including suction cups connected to the ends of the first suction tubes positioned adjacent the mattress.

3. The apparatus of claim 2 wherein the suction cups are positioned adjacent the sides and the bottom of the mattress.

4. The apparatus of claim 1 wherein the manifold forms part of the bed frame.

5. The apparatus of claim 4 wherein the manifold includes a plurality of rigid sections connected together by a flexible joint.

6. An oxygen removal system for a hospital bed having a frame, springs, and mattress comprising, a manifold having a plurality of sections connected to and supported from the frame, said sections being connected together by flexible joints, said manifold including a connection for attachment to exhaust means, a first plurality of suction tubes having one end connected to the manifold and another end including a suction cup, said suction cups positioned adjacent the sides and bottom of the mattress and supported from the frame and springs, and a second plurality of suction tubes connected to the manifold and extending downwardly under the mattress for removing oxygen from beneath the bed.

* * * * *